US008904587B1

(12) United States Patent
Patterson

(10) Patent No.: US 8,904,587 B1
(45) Date of Patent: Dec. 9, 2014

(54) HAND HELD ELECTRIC SHOE POLISHER

(71) Applicant: Ray Charles Patterson, Marina del Rey, CA (US)

(72) Inventor: Ray Charles Patterson, Marina del Rey, CA (US)

( * ) Notice: Subject to any disclaimer, the term of this patent is extended or adjusted under 35 U.S.C. 154(b) by 33 days.

(21) Appl. No.: 13/731,983

(22) Filed: Dec. 31, 2012

(51) Int. Cl.
*A47L 23/06* (2006.01)
*A46B 13/02* (2006.01)
*A47L 23/05* (2006.01)

(52) U.S. Cl.
CPC ..... *A47L 23/06* (2013.01); *A47L 23/05* (2013.01); *Y10S 15/01* (2013.01)
USPC ..... 15/28; 15/97.1; 15/97.2; 15/DIG. 1; 320/114; 320/134

(58) Field of Classification Search
USPC ..... 15/23, 28, 36, 97.1, 97.2, DIG. 1; 320/114, 115, 134
See application file for complete search history.

(56) References Cited

U.S. PATENT DOCUMENTS 4,158,246 A * 6/1979 Meadows et al. ..... 15/28
4,476,602 A * 10/1984 Hurn et al. ..... 15/28
4,916,770 A * 4/1990 Matsumoto ..... 15/28
5,551,114 A * 9/1996 Lee ..... 15/28
5,978,999 A * 11/1999 deBlois et al. ..... 15/22.1
7,425,815 B2 * 9/2008 Wong et al. ..... 320/141
7,791,319 B2 * 9/2010 Veselic et al. ..... 320/158
7,934,285 B2 * 5/2011 Nottingham et al. ..... 15/36
8,578,541 B2 * 11/2013 Bennett ..... 15/97.2
2005/0034254 A1 * 2/2005 Morsy ..... 15/28
2009/0096399 A1 * 4/2009 Chen et al. ..... 318/441
2011/0289702 A1 * 12/2011 Lee ..... 15/22.1

FOREIGN PATENT DOCUMENTS

DE 3110218 * 12/1982
EP 121087 * 10/1984

* cited by examiner

*Primary Examiner* — Mark Spisich
(74) *Attorney, Agent, or Firm* — Plager Schack LLP

(57) ABSTRACT

A handheld electric shoe polisher can quickly polish shoes in a compact device. The handheld electric shoe polisher comprises a housing mechanically coupled to hand grip. The housing is further mechanically coupled to universal service bus port and a switch. The housing is mechanically coupled to a drive shaft; the drive shaft is mechanically coupled to gear box. The gear box is mechanically coupled to a motor. The motor is electrically coupled to a battery. The drive shaft is further mechanically coupled to a shoe shine attachment. In this manner a user, can charge the battery by electrically coupling the universal service bus port to a power source and the user can engage the battery with the switch to power the motor, turning the drive shaft and causing the shoe shine attachment to rotate. The user can utilize the shoe shine attachment to shine shoes.

6 Claims, 3 Drawing Sheets

HAND HELD ELECTRIC SHOE POLISHER

FIELD OF THE INVENTION

This invention relates to devices that can clean, polish and shine shoes.

BACKGROUND OF THE INVENTION

Prior to the disclosed invention, there was no comprehensive theory for using a portable device to shine shoes. Rather, shoes have been shined manually for hundreds of years. In the 1960's, larger machines that stood on the ground and were located in a central location. See U.S. Pat. No. 3,339,219 issued to Bast. Bast and its progeny teach that alternating current (AC) systems are necessary to shine shoes. However, AC systems are not as portable as direct current (DC) systems that are taught in the present invention.

BRIEF SUMMARY OF THE INVENTION

A handheld electric shoe polisher can quickly polish shoes in a compact device. The handheld electric shoe polisher comprises a housing mechanically coupled to hand grip. The housing is further mechanically coupled to universal service bus port and a switch. The housing is mechanically coupled to a drive shaft; the drive shaft is mechanically coupled to gear box. The gear box is mechanically coupled to a motor. The motor is electrically coupled to a battery. The drive shaft is further mechanically coupled to a shoe shine attachment. In this manner a user, can charge the battery by electrically coupling the universal service bus port to a power source and the user can engage the battery with the switch to power the motor, turning the drive shaft and causing the shoe shine attachment to rotate. The user can utilize the shoe shine attachment to shine shoes.

BRIEF DESCRIPTION OF THE SEVERAL VIEWS OF THE DRAWINGS

Figure 1:
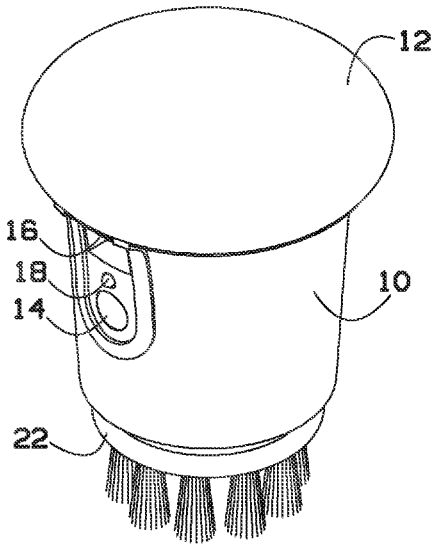

Having thus described the invention in general terms, reference will now be made to the accompanying drawings, which are not necessarily drawn to scale, and wherein:

FIG. 1 is a perspective view of the invention.

Figure 2:
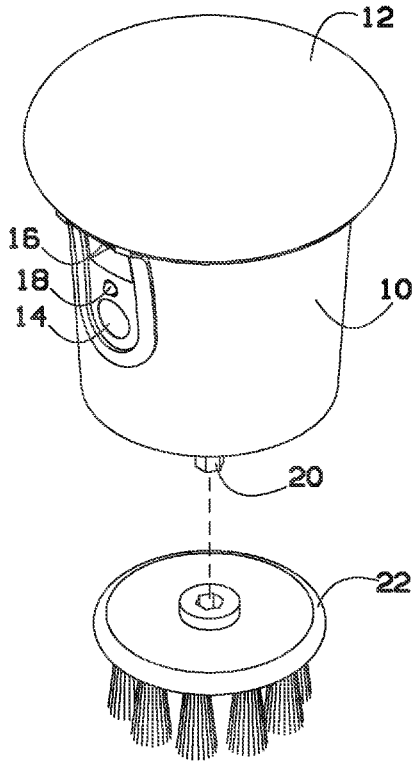

FIG. 2 is an exploded view of the invention.

Figure 3:
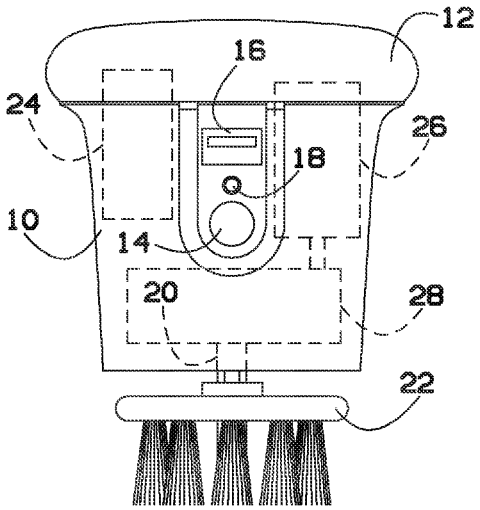

FIG. 3 is a front view of the invention.

Figure 4:
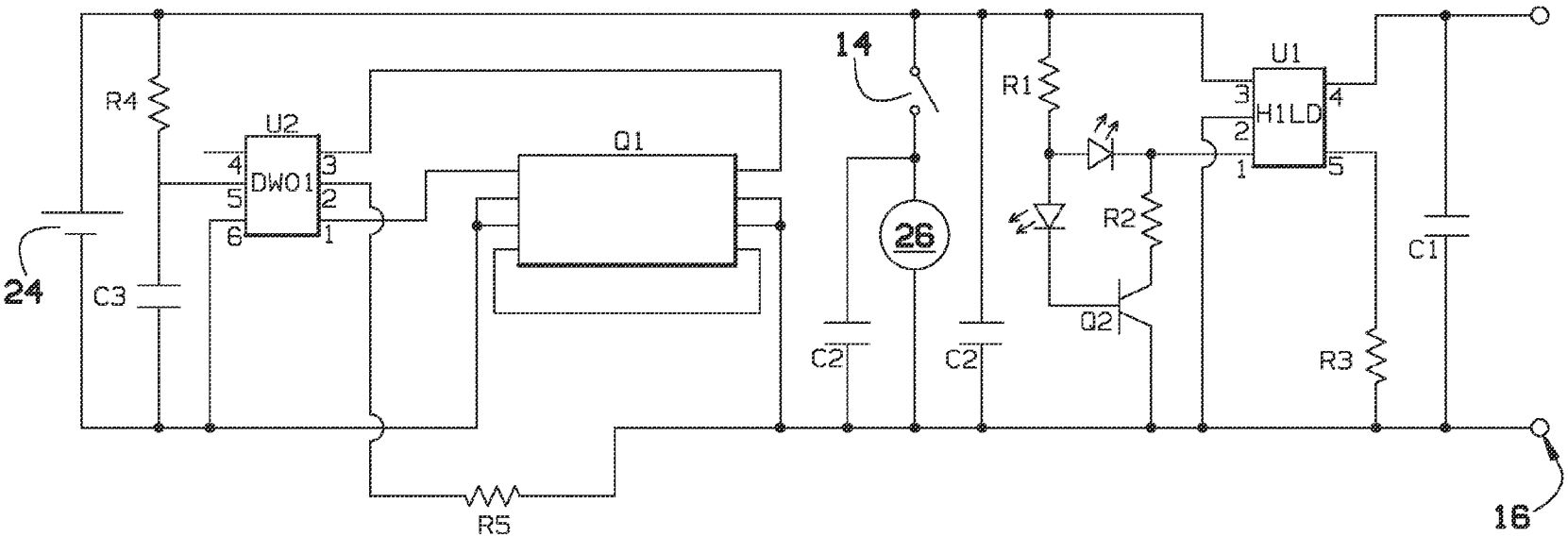

FIG. 4 is an electrical schematic of the invention.

Figure 5:
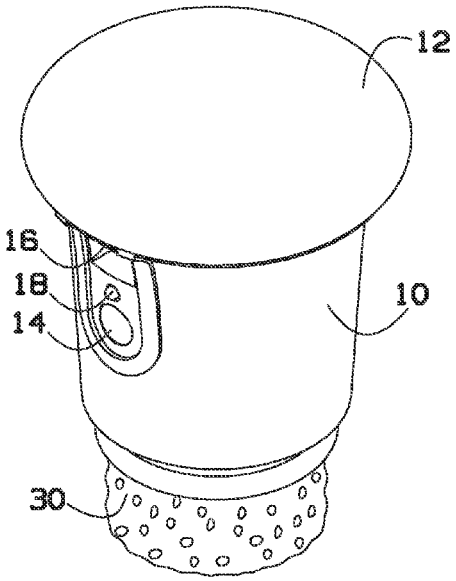

FIG. 5 shows the invention with a detachable sponge.

Figure 6:
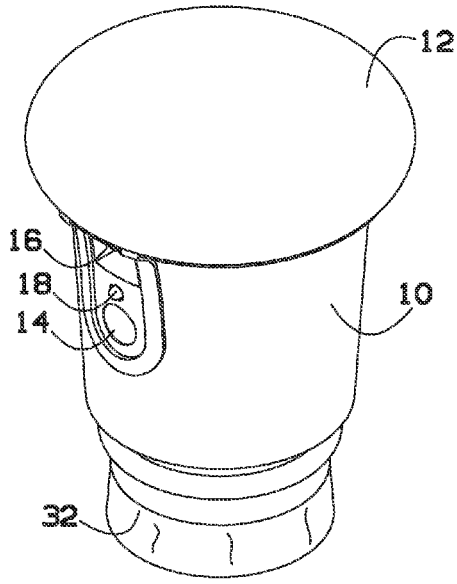

FIG. 6 shows the invention with a detachable wax pad.

Figure 7:
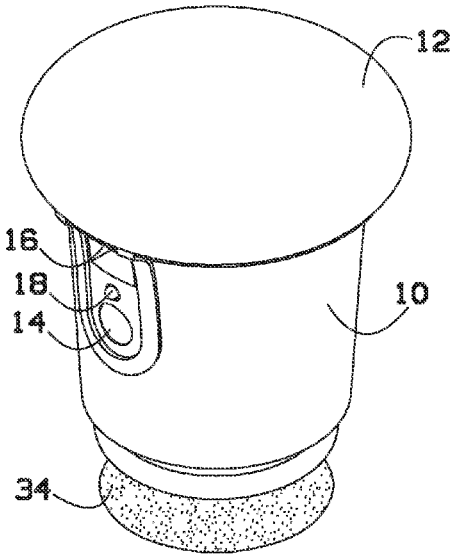

FIG. 7 shows the invention with a detachable buffer.

DETAILED DESCRIPTION OF THE INVENTION

Embodiments of the present invention overcome many of the obstacles associated with shining shoes with direct current (DC) machines, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 and FIG. 2 show perspective views of the invention, a handheld electric shoe polisher. The invention comprises housing 10 mechanically coupled to hand grip 12. Housing 10 is mechanically coupled to universal service bus port 16 (USB port 16), light emitting diode (LED) 18 and switch 14. As is known in the art, USB port 16 can be electrically coupled to a power source to provide direct current power to USB port 16. Housing 10 is mechanically coupled to drive shaft 20 which as shown in FIG. 2 and FIG. 3. Drive shaft 20 can be mechanically coupled to detachable brush 22 as shown in FIG. 3, detachable sponge 30 as shown in FIG. 5, detachable wax pad 32 as shown in FIG. 6 or detachable buffer 34 as shown in FIG. 7. Individually, as used in this application a "shoe shine attachment" refers to one of detachable brush 22, detachable sponge 30, detachable wax pad 32 or detachable buffer 34. Note that hand grip 12 can fit within the hand of a user making the invention a compact device.

Regardless of the shoe shine attachment selected, the handheld electric shoe polisher works in the following manner. Drive shaft 20 is mechanically coupled to gear box 28. Gear box 28 is mechanically coupled to motor 26. Motor 26 is electrically coupled to battery 24 with an integrated circuit as shown in FIG. 4.

FIG. 4 shows an electrical schematic of the integrated circuit that electrically couples battery 24 to motor 26. The integrated circuit comprises a metal-oxide-semiconductor field-effect transistor (MOSFET) electrically coupled to a battery protection integrated circuit (IC) and a battery charging circuit. While there are countless ways to do this, the following arrangement is the preferred embodiment.

The MOSFET is a dual n-channel enhancement mode MOSFET such as the HI-SINCERITY 8205A IC. Drain pin 1 is electrically coupled to drain pin 8. Second source pin 6 and second source pin 7 are electrically coupled to ground pin 6 on the battery protection IC and battery 24 in an RC circuit with capacitor C3 in series with resistor R4 and power supply pin 5. Second gate pin 5 on the MOSFET is electrically coupled to MOSFET gate connection pin 1 for discharge control. Likewise, first gate pin 4 on the MOSFET is electrically coupled to MOSFET gate connection pin 3 for discharge control. First source pin 2 and first source pin 3 are electrically coupled to input pin 2 for current sense and charger detection and resistor R5.

Second source pin 6 and second source pins 7 are electrically coupled to battery 24. Battery 24 is electrically coupled in parallel with two capacitors C2 and in series with switch 14. Collectively, this is the switching circuit.

Second source pin 6 and second source pin 7 are further electrically coupled to battery charging IC ground pin 2 and input supply voltage pin 5. The battery charging IC charging pin 3 is electrically coupled to a testing circuit, the switching circuit and battery 24. The testing circuit comprises resister R1 electrically coupled to a first diode and a second diode where the first diode is further electrically coupled to battery pin 1 and second resistor R2. The second diode and second resistor R2 are electrically coupled to gate Q2, where gate Q2 is further electrically coupled to battery charging IC ground pin 2.

USB port 16 is electrically coupled to program pin 4 and input supply voltage pin 5. Program pin 5 simply detects a current difference between USB port 16 and ground. If there is a difference the user desires to charge battery 24. If not, the user is content with the current level of charge in battery 24. If the user desires to charge battery 24 then battery charging IC ground pin 2, and battery charging IC charging pin 3 discern whether there is a difference in voltage between USB port 16 and battery 24, if so, then USB port 16 charges battery 24, if not, the batter 24 is charged and the battery protection integrated circuit prevents damage to battery 24 by using the MOSFET to redirect the current to ground. In this matter the MOSFET can efficiently detect whether battery 24 is charged and whether the user wants to charge battery 24, enabling efficient battery charging without risk of battery damage.

Shoes can be shined in the following manner: first, the user can apply wax to the shoe. After covering the shoe with wax the user can polish the wax into the shoe with detachable sponge 30 as shown in FIG. 7 by simply inserting detachable sponge 30 onto drive shaft 20. The user can then activate drive shaft 20 by using switch 14 as noted above; this allows a user to quickly cover the shoe with wax.

The user can buff out scuffs on the shoe with detachable brush 22 as shown in FIG. 2 by simply inserting detachable brush 22 onto drive shaft 20. The user can then activate drive shaft 20 by using switch 14 as noted above, the allows a user to quickly remove scuffs and blemishes from the shoe, while smoothing the wax on the shoe.

Finally, the user can buff the wax from detachable wax pad 32 onto the shoe with detachable buffer 34. The user can buff wax into a shoe with detachable buffer 34 as shown in FIG. 7 by simply inserting detachable buffer 34 onto drive shaft 20. The user can then activate drive shaft 20 by using switch 14 as noted above; this allows a user to quickly buff wax into the shoe.

In some embodiments, a user can user detachable wax pad 32. To do this the user can remove the show shine attachment and insert detachable wax pad 32 onto drive shaft 20. The present invention teaches that it is not necessary to engage drift shaft 20 with switch 14 in order to apply wax from detachable wax pad 32 onto the shoe. Rather, the user can simply rub detachable wax pad 32 against the shoe to apply wax to the shoe Of course the present invention is not limited to dress shoes and can be used to polish any kind of leather including tennis shoes, boots and other items of personal apparel and accessories.

That which is claimed:

1. A handheld electric shoe polisher, configured to quickly polish shoes in a compact device, the handheld electric shoe polisher comprises;

a housing mechanically coupled to hand grip; the housing is further mechanically coupled to universal service bus port and a switch;

the housing is mechanically coupled to a drive shaft; the drive shaft is mechanically coupled to a gear box; the gear box is mechanically coupled to a motor; the motor is electrically coupled to a battery with an integrated circuit; the battery is electrically coupled to the universal service bus port by the integrated circuit;

the integrated circuit comprises a MOSFET electrically coupled to a battery protection integrated circuit, a switching circuit and a battery charging circuit, where the battery charging circuit is electrically coupled to the battery and the battery protection integrated circuit is electrically coupled to the universal service bus port;

the MOSFET further comprises:

a first drain pin electrically coupled to a second drain pin; two second source pins are electrically coupled to a ground pin on the battery protection integrated circuit and the battery in an RC circuit having a capacitor in series with a resistor and a power supply pin;

a second gate pin is electrically coupled to a MOSFET gate connection pin for discharge control;

a first gate pin on the MOSFET is electrically coupled to another MOSFET gate connection pin for discharge control;

two source pins are electrically coupled to an input pin for current sense and charger detection;

the switching circuit further comprises: the battery electrically coupled in parallel with two capacitors and the switch;

the battery charging circuit further comprises: a battery charging circuit ground pin electrically coupled to the two second source pins, and an input supply voltage pin;

a testing circuit; electrically coupled to the battery charging circuit and further comprising: a resister electrically coupled to a first diode and a second diode wherein the first diode is further electrically coupled to a battery pin and a second resistor; a gate electrically coupled to the battery charging circuit ground pin and further electrically coupled to a third diode and a third resistor;

the drive shaft is further mechanically coupled to a shoe shine attachment;

in this manner, a user; can charge the battery by electrically coupling the universal service bus port to a power source and the user can engage the battery with the switch to power the motor, turning the drive shaft and causing the shoe shine attachment to rotate; the user can utilize the shoe shine attachment to shine shoes.

2. The handheld electric shoe polisher of claim 1, wherein the MOSFET is configured to efficiently detect whether the battery is charged and whether the user wants to charge the battery, thereby enabling an efficient battery charging without risk of battery damage.

3. The handheld electric shoe polisher of claim 1, wherein the shoe shine attachment is a detachable brush to remove debris from a shoe.

4. The handheld electric shoe polisher of claim 1, wherein the shoe shine attachment is a detachable wax pad for applying wax to a shoe.

5. The handheld electric shoe polisher of claim 1, wherein the shoe shine attachment is a detachable buffer for buffing wax on a shoe.

6. The handheld electric shoe polisher of claim 1, wherein the shoe shine attachment is a detachable sponge for polishing wax on a shoe.

* * * * *